US011278094B1

(12) United States Patent
Griffin et al.

(10) Patent No.: US 11,278,094 B1
(45) Date of Patent: Mar. 22, 2022

(54) CONTACTLESS CREDENTIALS HOLDER

(71) Applicant: SP Industries LLC, Lawrenceville, GA (US)

(72) Inventors: Joseph Griffin, Lawrenceville, GA (US); Michelle Bradley, Lawrenceville, GA (US)

( * ) Notice: Subject to any disclaimer, the term of this patent is extended or adjusted under 35 U.S.C. 154(b) by 0 days.

(21) Appl. No.: 17/396,678

(22) Filed: Aug. 7, 2021

Related U.S. Application Data

(63) Continuation-in-part of application No. 29/800,426, filed on Jul. 21, 2021.

(51) Int. Cl.
*A45C 5/04* (2006.01)
*A45C 13/02* (2006.01)
*A45C 13/00* (2006.01)

(52) U.S. Cl.
CPC ..... *A45C 5/04* (2013.01); *A45C 13/002* (2013.01); *A45C 13/02* (2013.01)

(58) Field of Classification Search
CPC ..... A45C 5/04; A45C 13/002; A45C 13/02; B65D 25/08; B65D 25/04; B65D 81/32; B65D 25/108; B65D 25/107; B65D 25/106; B65D 25/06; B65D 5/48012; B65D 5/48024; B65D 5/48038; B65D 5/5028; B65D 5/5085; B65D 71/0014; B65D 71/246; B65D 2501/24286; B65D 2571/00506; B65D 2571/00512
USPC ..... 206/425; 224/483, 277, 275, 542
See application file for complete search history.

(56) References Cited

U.S. PATENT DOCUMENTS

D114,637 S * 5/1939 Heil ..... D6/520
2,491,652 A * 12/1949 Feerick ..... A47B 57/58 211/71.01
2,510,211 A * 6/1950 Cleary ..... B65D 25/08 229/120.32
2,820,687 A * 1/1958 Waring ..... B60R 7/06 312/350
3,117,688 A * 1/1964 Walstad ..... B65D 25/06 217/7
4,305,520 A * 12/1981 Wagar ..... B42F 17/02 220/535
5,143,265 A * 9/1992 Schultz ..... B60N 3/12 224/483
5,228,569 A * 7/1993 House ..... B65D 71/00 206/372
7,661,559 B1 * 2/2010 Tresenfeld ..... B65D 35/34 222/94
9,414,660 B1 * 8/2016 Al-Hasan ..... A45C 5/065
2007/0051728 A1 * 3/2007 Bazany ..... B65D 25/04 220/529

(Continued)

*Primary Examiner* — J. Gregory Pickett
*Assistant Examiner* — Jenine Pagan
(74) *Attorney, Agent, or Firm* — Bochner IP, PLLC; Serge Krimnus

(57) ABSTRACT

Provided is a document holder having a first wall, a second wall, a top plate, a rear plate, a first divider, and a second divider, where the document holder is configured to interface with a receiving surface. Further, the document holder may include a slider that may traverse a first chamber, a second chamber, and a third chamber, where any of the chambers may include a document. The slider may reversibly conceal the document(s), enabling a third party to view the document(s) from an outside perspective when the slider is removed from the holder.

14 Claims, 3 Drawing Sheets

(56) References Cited

U.S. PATENT DOCUMENTS

2020/0346818 A1* 11/2020 Haskins ..... B65D 9/06

* cited by examiner

CONTACTLESS CREDENTIALS HOLDER

CLAIM OF PRIORITY

This application claims priority from U.S. Design patent application No. 29/800,426, filed on Jul. 21, 2021, the contents of which are incorporated herein by reference.

FIELD OF INVENTION

The invention is in the field of credential holders, specifically apparatuses and methods that enable contactless and non-reaching credential storage and presentation.

INTRODUCTION

There are estimates indicating that there are twenty to forty million traffic stops per year. At the onset of a traffic stop, a law enforcement officer will typically request the driver to provide a driver's license, car registration, and proof of insurance. For many individuals, these documents may be spread across multiple locations, including compartments in the car or on one's person. Thus, for many, the initial request for documents may lead to a feverish nerve-racking search for all of their appropriate documents.

Even in instances where a law enforcement officer is properly trained and the civilian is compliant, there is still a risk of injury to either party. The heightened stress, tension, and uncertainty of a traffic stop may manifest in misguided use of force by either party. For this reason, it is imperative that the traffic stop is a streamlined and risk averse as possible. Further, the act of gathering documents adds a great deal of time to the traffic stop, which both burdens the law enforcement officer who may have other calls and the driver who is keen on continuing their commute.

The act of reaching for documents in a glove compartment, center console, or an individual's pocket, may be interpreted to some as a means of acquiring a weapon, for example a pistol or blade. Accordingly, such movements may cause a law enforcement officer to perceive innocuous document gathering as a threat. Additionally, the civilian's knowledge of such a possibility may induce additional anxiety and nervousness, manifesting as apprehension and shaky, quick, and unpredictable movements. Such an effect actually exacerbates the original problem.

For many law enforcement officers, a major concern during a traffic stop is not being able to see the driver's hands when asked to produce credentials. Historically, this uncertainty has led to violent and sometimes lethal interactions due to fear of the driver reaching for weapons. Although having the driver's hands on the steering wheel is the safest position for all parties, maintaining such a position is physically impossible if the driver must reach for credentials.

Recently, the concepts of a Mobile Driver's License ("MDL") and digital documents (for example, stored on the civilian's mobile phone) eliminate much of the document-gathering stage of a traffic stop. However, such concepts still have a number of concerns. For example, there is the concern of privacy issues and liability once a law enforcement officer has taken control of the civilian's mobile device. Specifically, a law enforcement officer may be concerned about damaging the civilian's expensive mobile phone and the civilian may be concerned about a law enforcement officer viewing unrelated or private information on the mobile phone. Additionally, by virtue of being stored on an internet-connected mobile device, stored documents may be exposed to hacker exploitation.

Further, although a MDL stored on a mobile phone may decrease the amount of reaching performed by a civilian, transferring the mobile phone to the officer may still include drawing the mobile phone from one's pocket and reaching towards the officer.

It would be desirable to have apparatuses and methods that make routine traffic stops safer and more efficient for both vehicle operators and law enforcement officers.

Thus, it would be desirable to have apparatuses and methods of document storage and presentation that decrease the amount of reaching performed by the vehicle operator. Further, it would desirable to have apparatuses and methods configured to increase data security.

SUMMARY OF THE INVENTION

The invention may be a document holder, where the holder comprises a first wall and a second wall, where the first wall and the second wall are parallel, and where the first wall comprises a first slot. The holder may also comprise a top plate disposed orthogonal to the first wall and the second wall, the top plate in contact with the first wall and the second wall. The holder may further comprise a rear plate disposed orthogonal to the first wall, the second wall, and the top plate, the rear plate in contact with the first wall, the second wall, and the top plate. In a further embodiment, the holder includes a first base plate disposed orthogonal to the first wall, a second base plate disposed orthogonal to the second wall, a first divider disposed orthogonal to the top plate and the rear plate, and a second divider disposed orthogonal to the top plate and the rear plate. In an embodiment, the first divider and the second divider may be parallel to the first wall and the second wall, where the first divider comprises a first divider slot, and where the second divider comprises a second divider slot. In an embodiment, the holder includes a slider configured to removably traverse the first slot, the first divider slot, and the second divider slot. Further, the holder may include a first chamber bound by at least the first wall, the rear plate, and the first divider, a second chamber bound by at least the first divider, the rear plate, and the second divider, and a third chamber bound by at least the second divider, the rear plate, and the second wall.

In an embodiment, the document holder may further comprise a handle disposed on the slider. In a further embodiment, the handle may be larger than the first slot. The first base plate and the second base plate may comprise an adhesive configured to attach the document holder to a receiving surface. In an embodiment, the first base plate may be wider than the first wall and the second base plate may be wider than the second wall.

In an embodiment, the holder may comprise a first outer subchamber bound by at least the first wall, the rear plate, the first divider, the receiving surface, and the slider; a first inner subchamber bound by at least the first wall, the rear plate, the first divider, the top plate, and the slider; a second outer subchamber bound by at least the first divider, the rear plate, the second divider, the receiving surface, and the slider; a second inner subchamber bound by at least the first divider, the rear plate, the second divider, the top plate, and the slider; a third outer subchamber bound by at least the second divider, the rear plate, the second wall, the receiving surface, and the slider; and a third inner subchamber bound by at least the second divider, the rear plate, the second wall, the top plate, and the slider.

The slider may be configured to conceal the first inner subchamber, the second inner subchamber, and the third inner subchamber. In an embodiment, the slider bisects the first chamber into the first outer subchamber and the first inner subchamber; the second chamber into the second outer subchamber and the second inner subchamber; and/or the third chamber into the third outer subchamber and the third inner subchamber. In an embodiment, the first slot may be bound by the rear plate and the first wall; the first divider slot may be bound by the rear plate and the first divider; and/or the second divider slot may be bound by the rear plate and the second divider.

In an embodiment, the first chamber may have a first volume, the second chamber may have a second volume, and the third chamber may have a third volume, where the first volume, the second volume, and the third volume may be equivalent. In an embodiment, the slider may have a slider first end and a slider second end, where the slider second end may be configured to contact the second wall when the slider is fully inserted into the holder.

DETAILED DESCRIPTION OF THE PREFERRED EMBODIMENT

Figure 1:
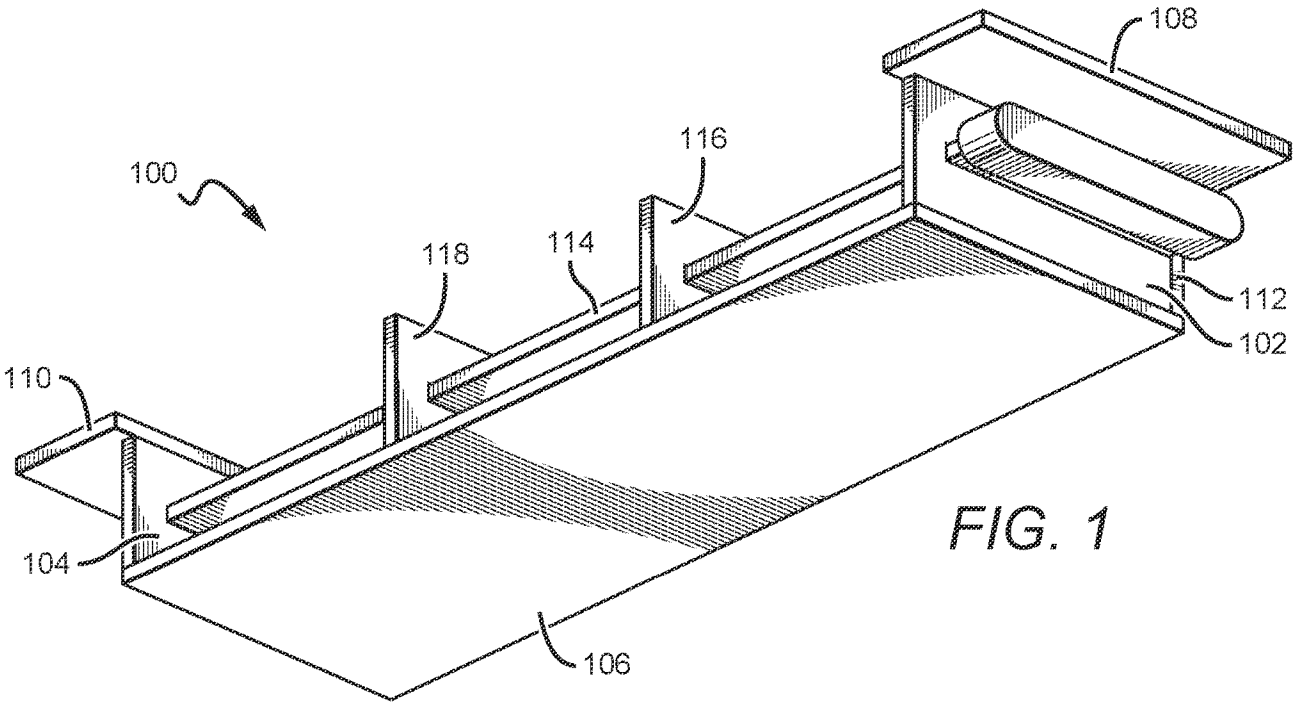
FIG. 1 is a bottom, front, right side perspective view of an embodiment of a credentials holder.

The present invention adds a whole new dimension to document storage and presentation by utilizing digital documentation and transfer methods.

Throughout the specification, wherever practicable, like structures will be identified by like reference numbers. In some figures, components, such as additional electrical connections or fasteners have been omitted for clarity in the drawings. Unless expressly stated otherwise, the term "or" means "either or both" such that "A or B" includes A alone, B alone, and both A and B together.

The invention of the present disclosure may be an apparatus that attaches to the windshield or dashboard of a vehicle (for example, with adhesive patches, such as hook and loop fasteners). In such an embodiment, the apparatus may be pre-loaded with a barcode (for example a QR code), which may be stored in the apparatus' slots. A slidable plate may be disposed within the apparatus, which can be withdrawn to allow access to barcodes and then replaced to a starting position with as little as two fingers.

Referring to FIG. 1, the holder 100 includes a first wall 102, a second wall 104, a top plate 106, a first base plate 108, and a second base plate 110. In an embodiment, the top plate 106 is disposed between the first wall 102 and the second wall 104, perpendicular to both the first wall 102 and second wall 104. In an embodiment, the first base plate 108 is disposed perpendicular to the first wall 102 and the second base plate 110 is disposed perpendicular to the second wall 104.

The holder 100 may also include a rear plate 112. The rear plate may be disposed perpendicular to the first wall 102, the second wall 104, and the top plate 106. A slider 114 may removably traverse the first wall 102, a first divider 116, a second divider 118, and/or the second wall 104.

The first base plate 108 and the second base plate 110 may be each include an outer surface, where the outer surface is configured to interface with a receiving surface. As a non-limiting example, the first base plate 108 and/or the second base plate 110 may be configured to interface with a vehicle's windshield. In an embodiment, the first base plate 108 and/or the second base plate 110 include a means of fastening the holder 100 to the receiving surface. As a non-limiting example, the first base plate 108 and/or the second base plate 110 may have an adhesive or fastener (for example, a hook and loop fastener), enabling the attachment of the holder 100 to the receiving surface.

In an embodiment, the first wall 102, second wall 104, first divider 116, and second divider 118 may each be parallel to each other. Thus, the first wall 102, second wall 104, first divider 116, and second divider 118 may be orthogonal to the top plate 106 and/or rear plate 112.

In an embodiment, the holder 100 includes a top opening, which is opposite the rear plate 112 and is bound by the first wall 102, the second wall 104, and the top plate 106. The top opening may enable fluid communication between the outside environment and the inside of the holder 100.

In an embodiment, the holder 100 may be comprised of plastic parts. However, in an alternate embodiment, the holder 100 may be comprised of components of any suitable material. In another embodiment, the holder 100 or a number of components of the holder 100 are manufactured via additive printing (for example, 3D printing).

In an embodiment, the first base plate 108 and/or the second base plate 110 are wider than the first wall 102 and/or second wall 104. In such an embodiment, the increased surface area of the first base plate 108 and/or second base plate 110 may enable a greater adhesion between the base plates 108-110 and the receiving surface. In an embodiment, the first base plate 108 may contact the first wall 102 and the rear plate 112 (for example, to increase stability of the first base plate 108). In an embodiment, the second base plate 108 may contact the second wall 104 and the rear plate 112 (for example, to increase stability of the second base plate 108). However, in an embodiment, the first base plate 108 and the second base plate 110 may only contact the first wall 102 and the second wall 104, respectively.

Figure 2:
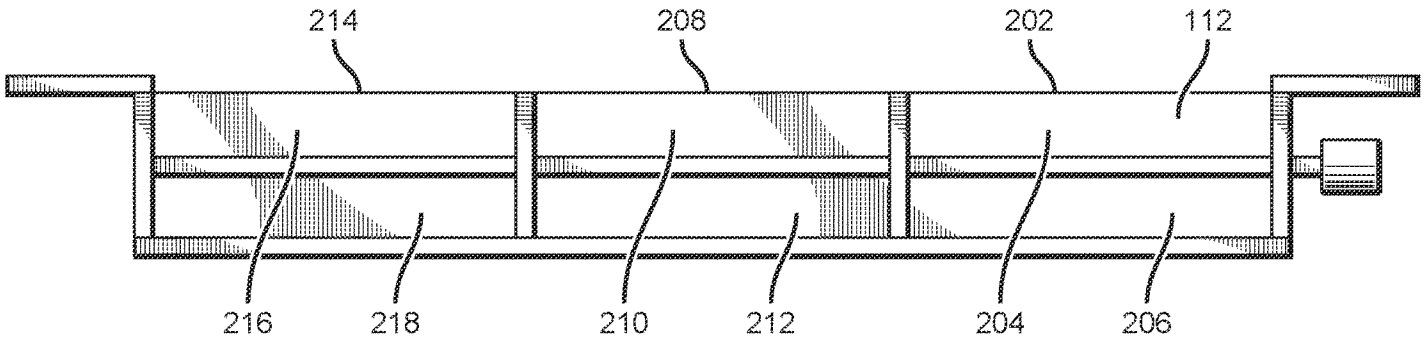
FIG. 2 is a front elevation view of an embodiment of a credentials holder.

Referring to FIG. 2, the holder may include a plurality of chambers, where each chamber may be divided into a plurality of subchambers. The first chamber 202 may be bound by a top opening, the first wall 102, the rear plate 112, the first divider 116, the top plate 106, and the receiving surface. The first outer subchamber 204 may be bound by the slider 114, the first wall 102, the rear plate 112, the first divider 116, the top opening, and the receiving surface. The first inner subchamber 206 may be bound by the slider 114, the first wall 102, the rear plate 112, the first divider 116, the top opening, and the top plate 106. The second chamber 208 may be bound by the rear plate 112, the first divider 116, the second divider 118, top plate 106, the top opening, and the receiving surface. The second outer subchamber 210 may be bound by the rear plate 112, the first divider 116, the second divider 118, slider 114, the top opening, and the receiving surface. The second inner subchamber 212 may be bound by the rear plate 112, the first divider 116, the second divider 118, slider 114, the top opening, and the slider 114. The third chamber 214 may be bound by the rear plate 112, the second wall 104, the second divider 118, top plate 106, the top opening, and the receiving surface. The third outer subchamber 216 may be bound by the rear plate 112, the second wall 104, the second divider 118, slider 114, the top opening, and the receiving surface. The third inner subchamber 216 may be bound by the rear plate 112, the second wall 104, the second divider 118, slider 114, the top opening, and the top plate 106.

In an embodiment, the first wall 102, second wall 104, first divider 116, and second divider 118 are disposed such that the first chamber 202, second chamber 208, and third chamber 214 have equal volumes. However, in alternate embodiments, the first wall 102, second wall 104, first divider 116, and second divider 118 may be disposed in a manner which creates chambers of any volumes and/or dimensions.

In an embodiment, each of the chambers may have inside dimensions of 2⅝"×1⅛". In an embodiment, the barcodes may be 1"×⅞". However, in various embodiments, the chambers and barcodes may be of any dimensions.

In an alternate embodiment, the holder 100 may include two chambers, for example a first chamber 202 and a second chamber 208. In such an alternate embodiment, the holder 100 may not include the second divider 118. In another alternate embodiment, the holder 100 may include more than three chambers, for example four chambers. In such an alternate embodiment, the holder 100 may include an additional divider or slider plate, for example a third divider, and an additional chamber, for example a fourth chamber, fourth inner subchamber, and fourth outer subchamber.

Figure 3:
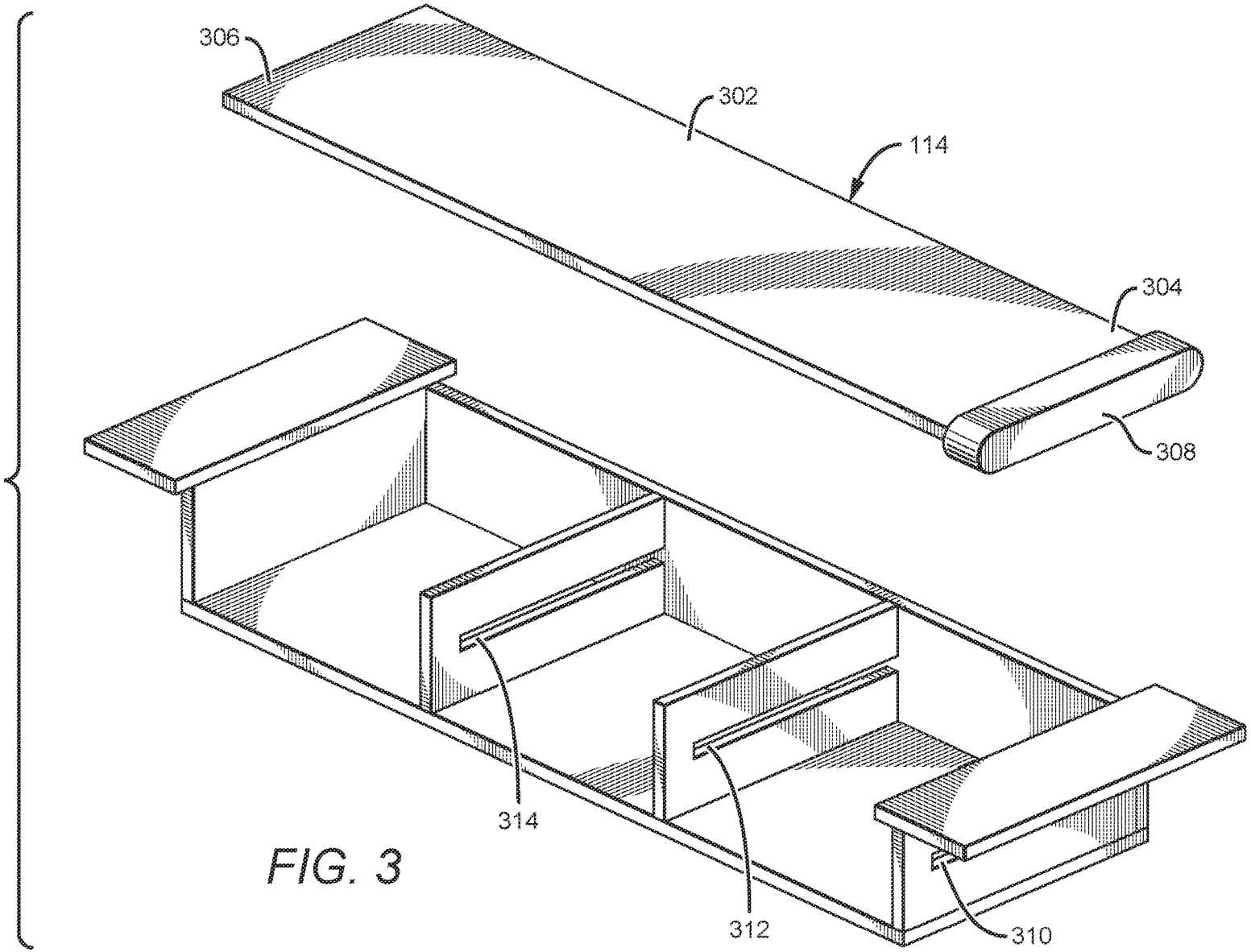
FIG. 3 is a top, font, right side exploded perspective view of a credentials holder comprising a slider.

Referring to FIG. 3, the slider 114 may include a slider plate 302, where the slider plate 302 includes a slider first end 304 and a slider second end 306. The slider first end 304 may include a handle 308. The holder may include a plurality of slots, where the slots are configured to accept the slider 114. The holder 100 may include a first slot 310, a first divider slot 312, and a second divider slot 314. The first slot 310 may be disposed on the first wall 102. The first divider slot 312 may be disposed on the first divider 116. The second divider slot 314 may be disposed on the second divider 118. In an alternate embodiment, a second wall slot is disposed on the second wall 104. In such an embodiment, the second wall slot may accept the slider second end 306.

In an embodiment, a tether (for example, a chain or bungee) is disposed between the slider 114 and the holder 100 (for example, between the handle 308 and the first wall 102). The tether may be configured and sized to prevent loss of the slider 114 when the slider 114 is removed from the holder 100. For example, the tether may be sized, such that when the slider 114 is removed, the slider 114 dangles several inches below the holder 100.

The slots 310-314 may be sized to accept the slider 114 and/or slider plate 302. For example, the slots 310-314 may be rectangular, having the same (or roughly the same) dimensions as a cross-section of the slider plate 302. The three slots 310-314 may each have the same dimensions. However, in an alternate embodiment, the three slots 310-314 may have different dimensions.

The slots 310-314 may be completely surrounded by the first wall 102, the first divider 116, and/or second divider 118. In an embodiment, the slots 310-314 may be partially surrounded by the first wall 102, the first divider 116, and/or the second divider 118. In such an embodiment, the slots 310-314 may also be bound by the rear plate 112 (for example, the slots 310-314 of FIG. 3, which open up to the rear plate 112). In an alternate embodiment, the slots 310-314 may be partially bound by the top opening. As a non-limiting example, the first divider slot 312 may have four internal sides, where three of the internal sides are formed by the first divider 116 and the fourth internal side is formed by the rear plate 112. In another non-limiting example, the first divider slot 312 may be bound by both the top opening and the first divider 116.

The handle 308 may be disposed on the slider first end 304. The handle 308 may be a rectangular prism, a cylindrical prism, or any geometric shape. The handle 308 may be sized such that the handle 308 may not be inserted past the first slot 310. The handle 308 may also include rounded edges.

In an embodiment, the slider 114 is sized such that, when fully inserted, the slider second end 306 is in contact with the second wall 104. In such an embodiment, the slider first end 304 may be proximate to the first wall 102. In an embodiment, when slider 114 is fully inserted, the handle 308 is in direct contact with the first wall 102. In another embodiment, when the slider 114 is fully inserted a distance exists between the handle 308 and the first wall 102 (for example, as depicted in FIG. 2). In such an embodiment, the distance between the handle 308 and the first wall 102 may increase convenience for the user when the user attempts to grasp the handle 308 and withdraw the slider 114.

In an embodiment, the slots 310-314 are positioned such that the slider 114 bisects the chambers 202, 208, 214. In such an embodiment, the first outer subchamber 204 and the first inner subchamber 206 have the same volume. However, in alternate embodiments, the slots 310-314 may be positioned such that the slider 114 creates subchambers of differing sizes. As a non-limiting example, the slots 310-314 may be positioned closer to the top plate 106 than the receiving surface, such that the first outer subchamber 204 is larger than first inner subchamber 206.

In an alternate embodiment, the holder 100 only includes a first slot 310 and a first divider slot 312. In such an alternate embodiment, the slider 114 may be sized such that, when inserted, the slider second end 316 interfaces with the second divider 118. Further, in such an alternate embodiment, the entirety of the third chamber 214 is exposed and the second inner subchamber 212 and first inner subchamber 206 are concealed when the slider 114 is inserted.

In an embodiment, the components of holder 100 may be molded together. However, the slider 114 may be molded separate. The slider 114 may be moved horizontally by the user. For example, the user may grasp the slider 114 by the handle 308 and slide the slider 114 horizontally. In such an example, the removal of the slider 114 may expose the contents of the chambers 202, 208, and 214 to the receiving surface or a third party observing the holder 100. In an embodiment, the slider 114 may conceal the contents of the first inner subchamber 206, the second inner subchamber 212, and the third inner subchamber 218, when the slider 114 is fully inserted into the holder 100. However, upon removal of the slider 114, each chamber and its contents may be fully viewable by a third party. In an embodiment, a user may choose to expose only certain chambers to the third party. For example, the user may withdraw the slider 114 from the holder 100 a distance which exposes the third inner subchamber 218 and the second inner subchamber 212, but leaves the first inner subchamber 206 concealed. In such an example, the slider 114 may removed from the second divider slot 314, but may maintain insertion in first divider slot 312 and the first slot 310.

In an embodiment, the holder 100 is configured for use with barcodes (for example, QR codes). The barcodes may contain documentation (for example, a MDL, car registration, proof of insurance). When the slider 114 is removed, exposing an inner subchamber, a third party may utilize a barcode scanner (for example, contained within a mobile phone) to retrieve the digital contents of the barcode. In an alternate embodiment, the chambers may contain paper documents (for example, a tangible driver's license, paper insurance records, and the paper car registration).

In an embodiment, the chambers 202-218 may be sized to accept a barcode (for example, a barcode printed on paper, plastic, or card stock). In an embodiment, each inner subchamber 206, 212, 218 may contain a barcode corresponding to a different individual (for example, the driver and two passengers). Alternatively, each inner subchamber 206, 212, 218 may be contain a barcode corresponding to different documents (for example, first inner subchamber 206 housing a barcode for a driver's license, second inner subchamber 212 housing a barcode for proof of insurance, and third inner subchamber 218 housing a barcode for vehicle registration). In a further embodiment, each inner subchamber 206, 212, 218 may contain more than one barcodes. In an embodiment, the barcodes may be inserted into the various chambers by the user via the top opening. In an embodiment, the barcodes may contain up to 3 KB of data. However, in another embodiment, the barcodes are not limited in capacity.

In an embodiment, the holder 100 does not include a slider 114. In such an embodiment, the chambers may be constantly exposed to a third party. In an alternate embodiment, the holder 100 includes a front plate disposed between the first wall 102, the second wall 104, and the top plate 106, opposite and/or parallel to the rear plate 112. In such an embodiment, the slider 114 may be inserted into the front plate, instead of the first wall 102. In a further alternate embodiment, the slider 114 may be inserted into the second wall 104 and/or the rear plate 112. In an embodiment where the holder 100 includes a front plate, each of the plates and walls may be composed of or may contain conductive material, creating a faraday cage. In such an embodiment, the holder 100 may protect the digital documents from malicious signals.

In an alternate embodiment, the slider 114 (for example, the slider second end 306) and/or the holder 100 (for example, the second wall 104) are fitted with magnets, such that when the slider 114 is fully inserted, the magnetic force between the two components maintains the slider 114 in the holder 100.

Figure 4:
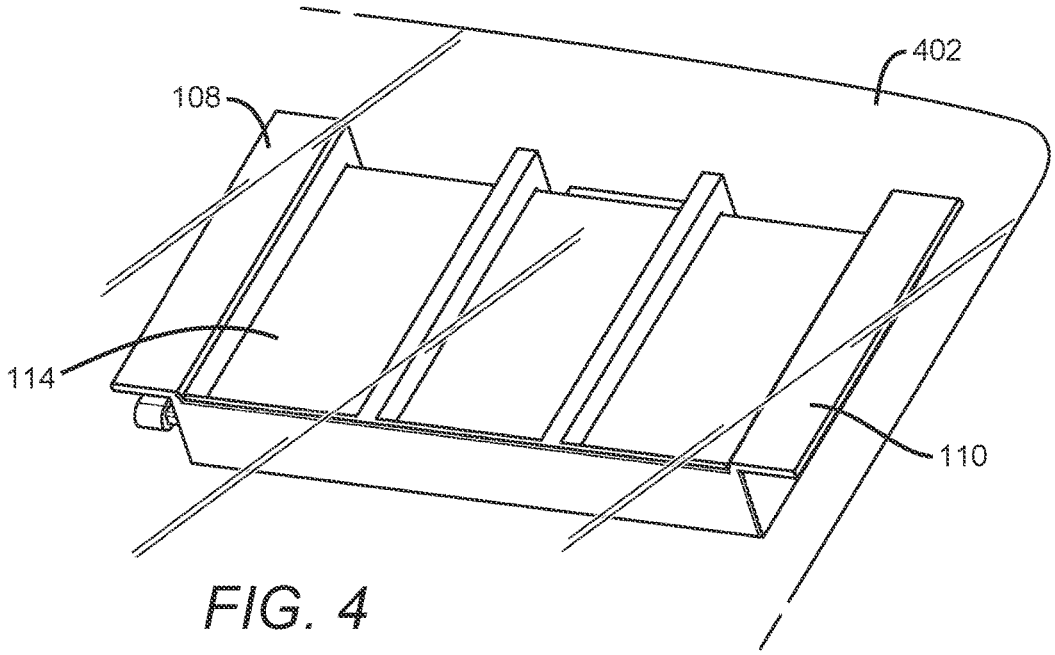
FIG. 4 is an illustration of the holder in a concealed setting interfacing with a receiving surface.

FIG. 4 is an illustration of the holder 100 in a concealed setting interfacing with a receiving surface 402. The receiving surface 402 may be a vehicle windshield or window. However, in an alternate embodiment, the receiving surface 402 may be any transparent or partially transparent surface. The holder 100 may be in its concealed setting when the slider 114 is fully inserted into the holder 100 (for example, traversing all three chambers). In such an embodiment, contents of the first inner subchamber 206, the second inner subchamber 212, and/or the third inner subchamber 218 may be concealed from the viewpoint of an individual on the opposite side of the receiving surface 402.

In an embodiment, the width of the slider 114 completely conceals the contents of the inner subchambers from view. However, in an alternate embodiment, the slider 114 may be of a width where the slider 114 partially conceals the contents of the inner subchambers. For example, via partial concealment, certain innocuous identifying details on the documents may be immediately visible to a third party.

In an embodiment, the first base plate 108 and/or the second base plate 110 include an adhesive layer. The adhesive layer may be disposed across the entire surface of the first base plate 108 and/or the second base plate 110 that interfaces with the receiving surface 402. However, in an alternate embodiment, the adhesive layer may be applied partially to the first base plate 108 and/or the second base plate 110. In another alternate embodiment, the interfacing portions (for example, the portions of the holder 100 that interface with the receiving surface 402) of the rear plate 112, first divider 116, and/or second divider 118 include an adhesive.

In an embodiment, an adhesive retaining layer is disposed atop the adhesive layer. For example, the adhesive retaining layer may be a layer of paper or plastic configured to protect the adhesive layer before the user adheres the holder 100 to the receiving surface 402. As a non-limiting example, the adhesive retaining layer may be a peelable paper layer that the user may remove before attaching the holder 100 to the receiving surface 402. In another embodiment, the holder 100 may be attached to receiving surface 402 by any suitable means of fastening (for example, hook and loop, magnet, suction cup, etc.). As a non-limiting example, the holder 100 (for example, the first base plate 108 and/or the second base plate 110) may have a first fastener layer and the receiving surface 402 may have a complimentary fastener layer. Further, in such a non-limiting example, the user may apply a first layer of fastener to the holder 100 and a second complimentary layer of fastener to the receiving surface 402, such that the first layer of fastener and the second layer of fastener adhere to one another.

Figure 5:
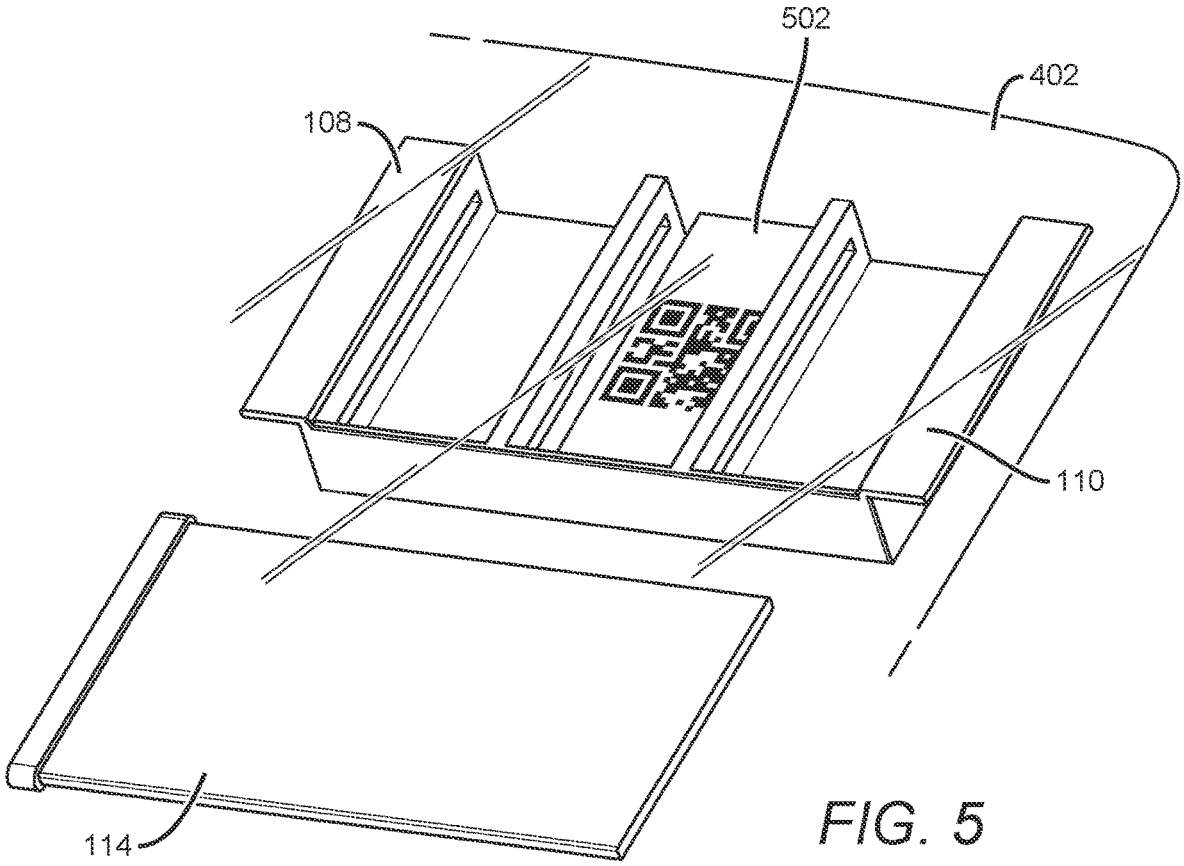
FIG. 5 is an illustration of the holder in an open setting interfacing with a receiving surface.

FIG. 5 is an illustration of the holder in an open setting interfacing with a receiving surface 402. In an open setting the contents of the first inner subchamber 206, the second inner subchamber 212, and/or the third inner subchamber 218 may be viewable from the viewpoint of an individual on the opposite side of the receiving surface 402. The first inner subchamber 206, the second inner subchamber 212, and/or the third inner subchamber 218 may contain a document 502. The document 502 may be a QR code or barcode, enabling a third-party to scan the document 502 and retrieve information electronically on their own electronic device. As a non-limiting example, the document 502 may be a QR code for an electronic drivers license. A third-party, for example a law enforcement office, may scan the document 502 with their smart phone to retrieve the driver's license. In such a non-limiting example, the officer may retrieve the driver's information with minimal contacts to the driver. Once the traffic stop has ended, the user may reinsert the slider 114 to conceal the document 502.

The holder 100 may include any number and/or combination of documents 502. In an embodiment, the first inner subchamber 206, the second inner subchamber 212, and/or the third inner subchamber 218 may be sized to accept the document 502. For example, the width of each chamber 206/212/218 may be sized such that a QR code may effectively be scanned by a third party with a smart phone from roughly four inches from the receiving surface 402. However, the chambers 206/212/218 and/or the document 502 may be of any dimension that enables a third-party to accurately retrieve information from the document 502 from outside the receiving surface 402.

While certain novel features of the present invention have been shown and described, it will be understood that various omissions, substitutions and changes in the forms and details of the device illustrated and in its operation can be made by those skilled in the art without departing from the spirit of the invention.

What is claimed is:

1. A document holder, the holder comprising:

a first wall and a second wall, wherein the first wall and the second wall are parallel, and wherein the first wall comprises a first slot;

a top plate disposed orthogonal to the first wall and the second wall, the top plate in contact with the first wall and the second wall;

a rear plate disposed orthogonal to the first wall, the second wall, and the top plate, the rear plate in contact with the first wall, the second wall, and the top plate;

a first base plate disposed orthogonal to the first wall;

a second base plate disposed orthogonal to the second wall, wherein the first base plate and the second base plate comprise an adhesive configured to attach the document holder to a receiving surface;

a first divider disposed orthogonal to the top plate and the rear plate;

a second divider disposed orthogonal to the top plate and the rear plate, wherein the first divider and the second divider are parallel to the first wall and the second wall, wherein the first divider comprises a first divider slot, and wherein the second divider comprises a second divider slot;

a slider configured to removably traverse the first slot, the first divider slot, and the second divider slot;

a first chamber bound by at least the first wall, the rear plate, and the first divider;

a second chamber bound by at least the first divider, the rear plate, and the second divider; and a third chamber bound by at least the second divider, the rear plate, and the second wall.

2. The document holder of claim 1, further comprising a handle disposed on the slider.

3. The document holder of claim 2, wherein the handle is larger than the first slot.

4. The document holder of claim 1, wherein the first base plate is wider than the first wall and the second base plate is wider than the second wall.

5. The document holder of claim 1, further comprising:

a first outer subchamber bound by at least the first wall, the rear plate, the first divider, the receiving surface, and the slider;

a first inner subchamber bound by at least the first wall, the rear plate, the first divider, the top plate, and the slider;

a second outer subchamber bound by at least the first divider, the rear plate, the second divider, the receiving surface, and the slider;

a second inner subchamber bound by at least the first divider, the rear plate, the second divider, the top plate, and the slider;

a third outer subchamber bound by at least the second divider, the rear plate, the second wall, the receiving surface, and the slider; and a third inner subchamber bound by at least the second divider, the rear plate, the second wall, the top plate, and the slider.

6. The document holder of claim 5, wherein the slider is configured to conceal the first inner subchamber, the second inner subchamber, and the third inner subchamber.

7. The document holder of claim 6, wherein the slider bisects the first chamber into the first outer subchamber and the first inner subchamber.

8. The document holder of claim 7, wherein the slider bisects the second chamber into the second outer subchamber and the second inner subchamber.

9. The document holder of claim 8, wherein the slider bisects the third chamber into the third outer subchamber and the third inner subchamber.

10. The document holder of claim 6, wherein the first slot is bound by the rear plate and the first wall.

11. The document holder of claim 10, wherein the first divider slot is bound by the rear plate and the first divider.

12. The document holder of claim 11, wherein the second divider slot is bound by the rear plate and the second divider.

13. The document holder of claim 6, wherein the first chamber has a first volume, the second chamber has a second volume, and the third chamber has a third volume, wherein the first volume, the second volume, and the third volume are equivalent.

14. The document holder of claim 6, wherein the slider has a slider first end and a slider second end, wherein the slider second end is configured to contact the second wall when the slider is fully inserted into the holder.

* * * * *